US009259606B2

(12) United States Patent
Wolan

(10) Patent No.: US 9,259,606 B2
(45) Date of Patent: Feb. 16, 2016

(54) PORTABLE RESISTANCE BAND EXERCISE MACHINE

(71) Applicant: Edward Anthony Wolan, Meridian, MS (US)

(72) Inventor: Edward Anthony Wolan, Meridian, MS (US)

( * ) Notice: Subject to any disclaimer, the term of this patent is extended or adjusted under 35 U.S.C. 154(b) by 34 days.

(21) Appl. No.: 14/098,235

(22) Filed: Dec. 5, 2013

(65) Prior Publication Data

US 2014/0155232 A1 Jun. 5, 2014

Related U.S. Application Data

(60) Provisional application No. 61/733,705, filed on Dec. 5, 2012.

(51) Int. Cl.

| | |
|---|---|
| ***A63B 21/02*** | (2006.01) |
| ***A63B 21/04*** | (2006.01) |
| ***A63B 21/00*** | (2006.01) |
| ***A63B 23/12*** | (2006.01) |

(52) U.S. Cl.

CPC ..... *A63B 21/0442* (2013.01); *A63B 21/00065* (2013.01); *A63B 21/1465* (2013.01); *A63B 21/1484* (2013.01); *A63B 21/4033* (2015.10); *A63B 21/4043* (2015.10); *A63B 23/1281* (2013.01); *A63B 2210/50* (2013.01)

(58) Field of Classification Search

CPC ..... A63B 21/0442; A63B 23/1281; A63B 21/1484; A63B 21/00065; A63B 21/1465; A63B 2210/50; A63B 21/00043; A63B 21/1492; A63B 23/1209; A63B 23/1245

See application file for complete search history.

(56) References Cited

U.S. PATENT DOCUMENTS

| | | | | | |
|---|---|---|---|---|---|
| 118,740 | A | * | 9/1871 | O'Connor | 482/123 |
| 189,356 | A | * | 4/1877 | Hanson et al. | 73/379.08 |
| 1,623,670 | A | * | 4/1927 | Frankenfeld | 482/123 |
| 1,691,092 | A | * | 11/1928 | Weimer | 482/123 |
| 1,990,124 | A | * | 2/1935 | Kabisius | 482/56 |
| 3,345,067 | A | * | 10/1967 | Smith | 482/123 |
| 4,089,520 | A | * | 5/1978 | Ozbey et al. | 482/130 |
| 4,273,327 | A | * | 6/1981 | Nall et al. | 482/71 |
| 4,371,162 | A | * | 2/1983 | Hartzell | 482/123 |
| 4,403,773 | A | * | 9/1983 | Swann | 482/130 |
| 4,787,630 | A | * | 11/1988 | Watson et al. | 482/146 |
| 4,982,958 | A | * | 1/1991 | Ullman | 482/123 |
| 5,013,034 | A | * | 5/1991 | March et al. | 482/115 |
| 5,171,295 | A | * | 12/1992 | Schwalm, Jr. | 482/131 |
| 5,178,596 | A | * | 1/1993 | McIntire | 482/80 |
| 5,269,737 | A | * | 12/1993 | Sobotka | 482/123 |
| 5,292,297 | A | * | 3/1994 | Hsu | 482/146 |
| 5,352,176 | A | * | 10/1994 | Huang | 482/146 |
| 5,391,134 | A | * | 2/1995 | Heatwole | 482/146 |
| 5,413,543 | A | * | 5/1995 | Drago | 482/49 |
| 5,529,552 | A | * | 6/1996 | Biedermann et al. | 482/51 |
| 5,785,667 | A | * | 7/1998 | Forner | 601/23 |
| 6,004,248 | A | * | 12/1999 | Price | 482/121 |
| 6,110,081 | A | * | 8/2000 | Barrett | 482/121 |
| 6,245,001 | B1 | * | 6/2001 | Siaperas | 482/142 |
| 6,254,517 | B1 | * | 7/2001 | Kennedy | 482/121 |

(Continued)

*Primary Examiner* — Oren Ginsberg
*Assistant Examiner* — Gary D Urbiel Goldner

(57) ABSTRACT

A portable exercise machine utilizing resistance bands is provided. The exercise machine includes a platform and a pair of arms attached to the platform. The pair of arms may extend laterally away from the platform. Resistance bands may be attached to the arms. A user may thereby stand on the platform and/or straps and use the resistance bands for exercise. The arms may further pivot relative to the platform, allowing the user to perform a plurality of different exercises.

6 Claims, 4 Drawing Sheets

(56) References Cited

U.S. PATENT DOCUMENTS

| | | | | |
|---|---|---|---|---|
| 6,461,285 | B1 * | 10/2002 | Theunissen et al. | 482/146 |
| 6,544,152 | B2 * | 4/2003 | Rosati | 482/126 |
| D482,748 | S * | 11/2003 | Flynt | D21/692 |
| 6,740,008 | B1 * | 5/2004 | Ho et al. | 482/34 |
| 6,746,372 | B2 * | 6/2004 | Hsu | 482/34 |
| 6,872,175 | B2 * | 3/2005 | Lin | 482/146 |
| 7,112,168 | B2 * | 9/2006 | Dalebout et al. | 482/146 |
| 7,115,078 | B1 * | 10/2006 | Kalember et al. | 482/117 |
| 7,217,228 | B2 * | 5/2007 | Marquez | 482/130 |
| 7,250,021 | B2 * | 7/2007 | Leight | 482/116 |
| 7,410,450 | B1 * | 8/2008 | Paulding | 482/121 |
| 7,431,681 | B1 | 10/2008 | Cyr | |
| 7,591,763 | B1 * | 9/2009 | Fucci | 482/52 |
| 7,824,317 | B2 * | 11/2010 | Nakamura | 482/134 |
| 7,862,484 | B1 * | 1/2011 | Coffey | 482/72 |
| D634,377 | S * | 3/2011 | Byle | D21/686 |
| 7,942,793 | B2 * | 5/2011 | Mills et al. | 482/130 |
| 7,946,969 | B1 * | 5/2011 | Friess et al. | 482/123 |
| 8,033,969 | B2 * | 10/2011 | Feltz | 482/142 |
| 8,075,453 | B1 * | 12/2011 | Wilkinson | 482/51 |
| 8,088,050 | B2 * | 1/2012 | Aucamp | 482/131 |
| 8,109,860 | B2 * | 2/2012 | Lo | 482/51 |
| 8,398,530 | B1 * | 3/2013 | Rubens | 482/131 |
| 8,465,401 | B1 | 6/2013 | Ihli | |
| 8,500,612 | B2 * | 8/2013 | Koch et al. | 482/129 |
| 8,632,443 | B2 * | 1/2014 | Hauptmann | 482/130 |
| 8,636,630 | B2 * | 1/2014 | Morris | 482/117 |
| 8,715,144 | B1 * | 5/2014 | Friess et al. | 482/123 |
| 8,979,720 | B2 * | 3/2015 | Brentham et al. | 482/112 |
| 2003/0211920 | A1 * | 11/2003 | Mandel | 482/116 |
| 2004/0014570 | A1 * | 1/2004 | Centopani | 482/140 |
| 2005/0032613 | A1 * | 2/2005 | Wehrell | 482/133 |
| 2005/0130814 | A1 * | 6/2005 | Nitta et al. | 482/121 |
| 2006/0100074 | A1 * | 5/2006 | Murdoch | 482/142 |
| 2006/0128540 | A1 * | 6/2006 | Engle | 482/123 |
| 2006/0199706 | A1 * | 9/2006 | Wehrell | 482/92 |
| 2007/0015644 | A1 * | 1/2007 | Aucamp | 482/130 |
| 2007/0037678 | A1 * | 2/2007 | Schaefer et al. | 482/121 |
| 2007/0087920 | A1 * | 4/2007 | Dachraoui et al. | 482/123 |
| 2007/0129226 | A1 * | 6/2007 | Leavitt | 482/129 |
| 2007/0129227 | A1 * | 6/2007 | Suaste | 482/146 |
| 2007/0155602 | A1 * | 7/2007 | Huls | 482/140 |
| 2007/0270292 | A1 * | 11/2007 | Laney | 482/121 |
| 2008/0171642 | A1 * | 7/2008 | Cassidy et al. | 482/121 |
| 2008/0318743 | A1 * | 12/2008 | Bizzell et al. | 482/142 |
| 2009/0098987 | A1 * | 4/2009 | McBride et al. | 482/133 |
| 2010/0126902 | A1 * | 5/2010 | Garza et al. | 206/579 |
| 2010/0167886 | A1 * | 7/2010 | Ko | 482/123 |
| 2010/0204023 | A1 * | 8/2010 | Mills et al. | 482/121 |
| 2011/0009248 | A1 * | 1/2011 | Bronston et al. | 482/124 |
| 2011/0105277 | A1 * | 5/2011 | Shauli | 482/4 |
| 2011/0143896 | A1 * | 6/2011 | Senegal | 482/139 |
| 2011/0251033 | A1 * | 10/2011 | Blancher | 482/123 |
| 2012/0172183 | A1 * | 7/2012 | Tyree | 482/129 |
| 2013/0017934 | A1 * | 1/2013 | Tayebi | 482/129 |
| 2013/0079203 | A1 * | 3/2013 | Jones | 482/130 |
| 2013/0190146 | A1 | 7/2013 | Thomas | |
| 2014/0038796 | A1 * | 2/2014 | Shifferaw | 482/142 |
| 2014/0087927 | A1 * | 3/2014 | Richard et al. | 482/123 |
| 2014/0113773 | A1 * | 4/2014 | Marghella | 482/38 |

* cited by examiner

PORTABLE RESISTANCE BAND EXERCISE MACHINE

CROSS-REFERENCE TO RELATED APPLICATION

This application claims the benefit of priority of U.S. provisional application No. 61/733,705, filed Dec. 5, 2012, the contents of which are herein incorporated by reference.

BACKGROUND OF THE INVENTION

The present invention relates to a portable resistance band exercise machine and, more particularly, to a platform with extending arms and the resistance bands attached to the extending arms.

An exercise machine may be any machine used for physical exercise, such as weight lifting machines and cardio machines. Typically, exercise machines are very bulky and are not easily portable. Further, many exercise machines only work out a few body parts and the resistance is very limited.

As can be seen, there is a need for a versatile and lightweight exercise machine.

SUMMARY OF THE INVENTION

In one aspect of the present invention, an exercise apparatus comprises: a substantially flat platform comprising a top surface and an edge comprising a perimeter; a plurality of arms each comprising a first end and a second end, wherein the end of the plurality of arms are attached to the platform and the plurality of arms extend outwardly past the perimeter of the platform; and a plurality of resistance bands, wherein at least one resistance band is attached to the second end of each of the plurality of arms.

These and other features, aspects and advantages of the present invention will become better understood with reference to the following drawings, description and claims.

DETAILED DESCRIPTION OF THE INVENTION

Figure 1:
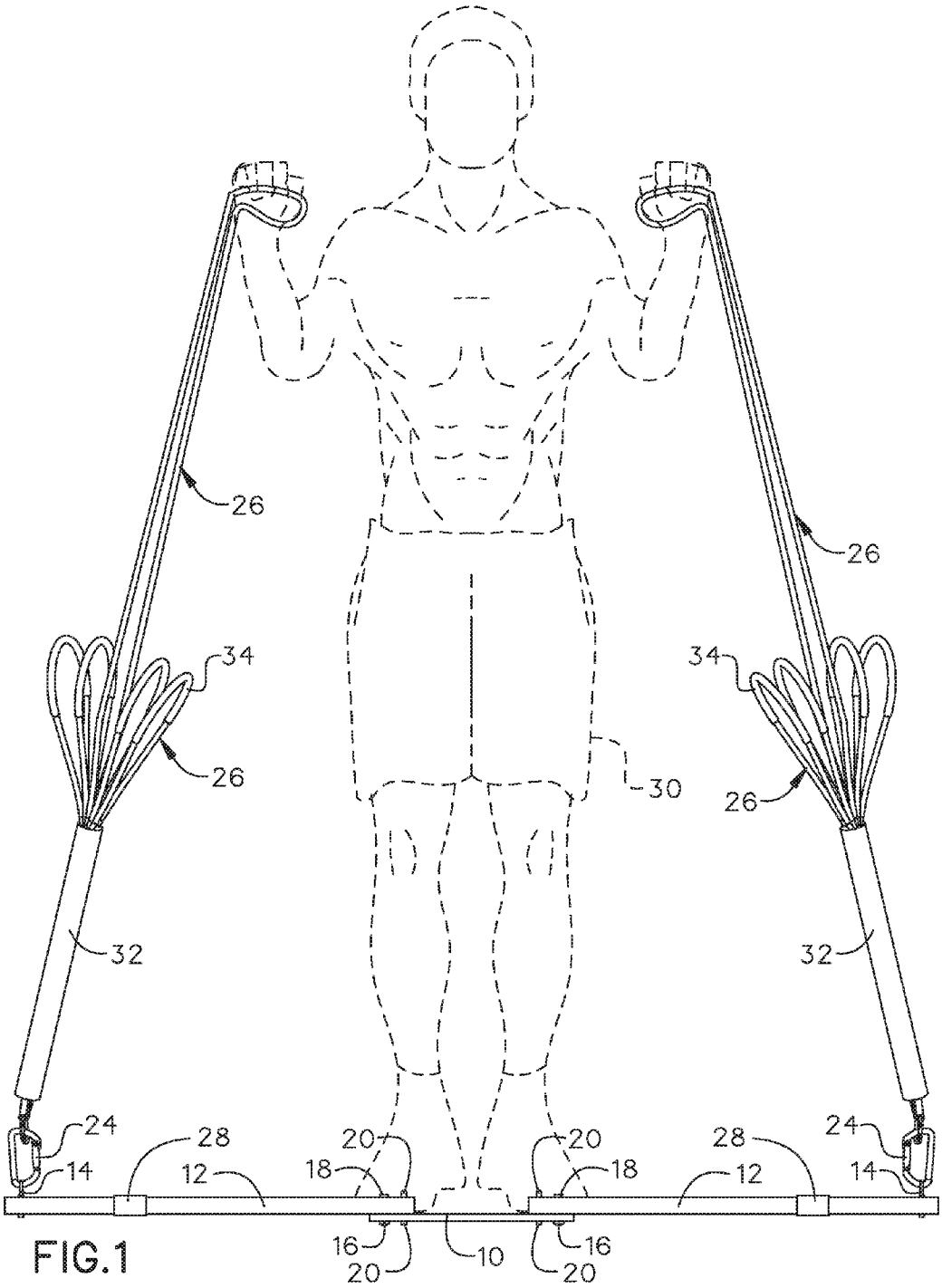
FIG. 1 is a front view of the present invention shown in use.
Figures 2, 3:
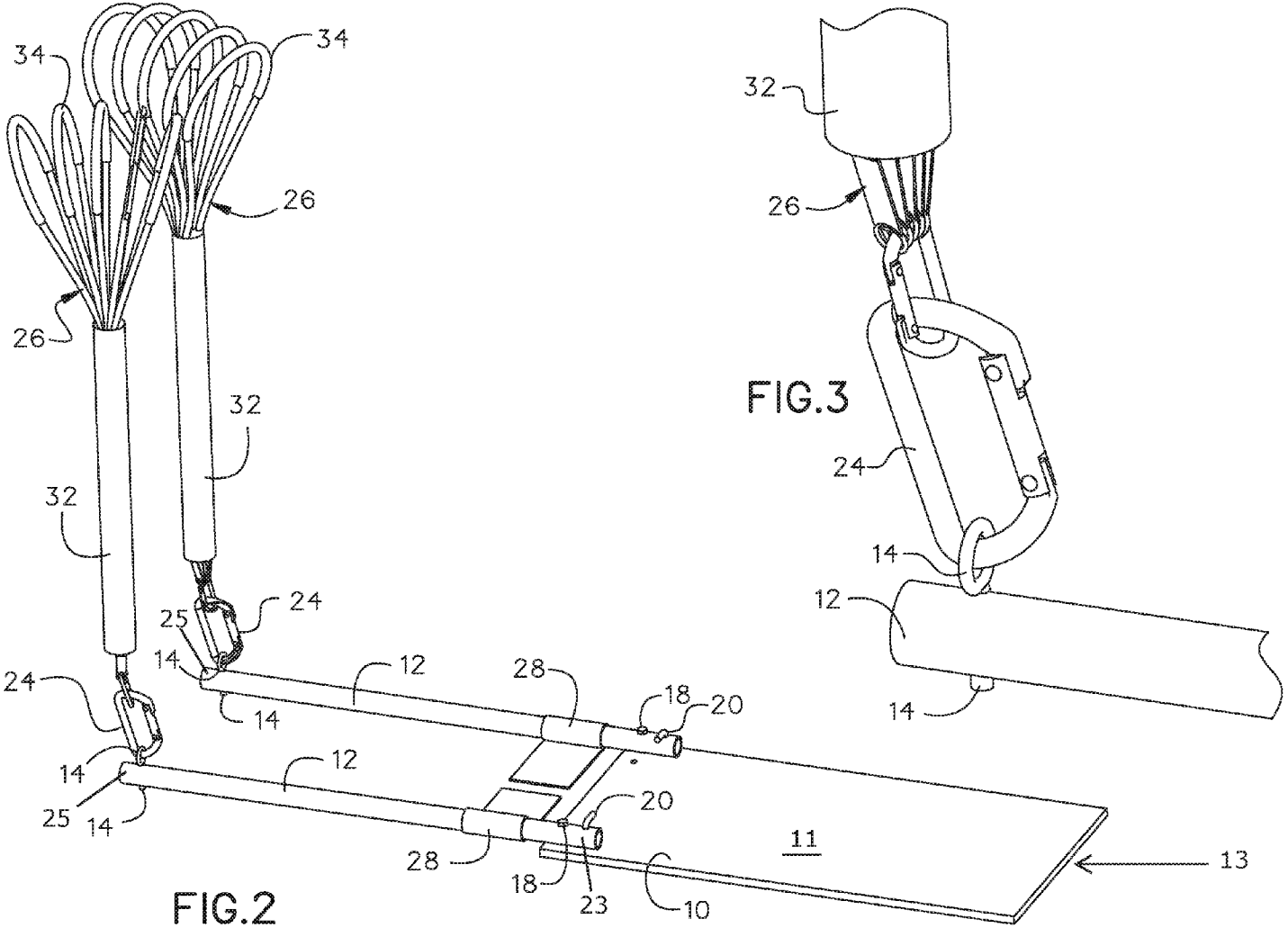
FIG. 2 is a perspective view of the present invention.
FIG. 3 is a detail perspective view of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention may include a lightweight portable gym using resistance bands at each end of rotational arms that are attached to a base. The present invention may only weigh around twelve pounds and may include a set of resistance bands at each end of the rotational arms. The user may choose one or more of the bands to perform many different exercises. In certain embodiments, the resistance bands may vary in resistance, allowing users to choose the intensity of the workout. Further, the present invention may be repositioned and may be used for many different exercises working out many different body parts, similar to a full set of gym equipment.

Broadly, an embodiment of the present invention provides a portable exercise machine utilizing resistance bands. The exercise machine includes a platform and a pair of arms attached to the platform. The pair of arms may extend laterally away from the platform. Resistance bands may be attached to the arms. A user may thereby stand on the platform and use the resistance bands for exercise. The arms may further pivot relative to the platform, allowing the user to perform a plurality of different exercises.

The present invention may include a substantially flat platform 10. The platform 10 may include a top surface 11, an edge 13 that forms a perimeter, a first end 15, a second end 17, a first side 19 and a second side 21. The present invention may include a plurality of arms 12 each having a first end 23 and a second end 25. The first end 23 may be attached to the platform 10 and extend outwardly past the perimeter of the platform 10. The present invention may further include resistance bands 26. At least one resistance band 26 is attached to the second end 25 of each of the plurality of arms 12. In certain embodiments, straps 28 may be attached to the arms 12.

Figure 4:
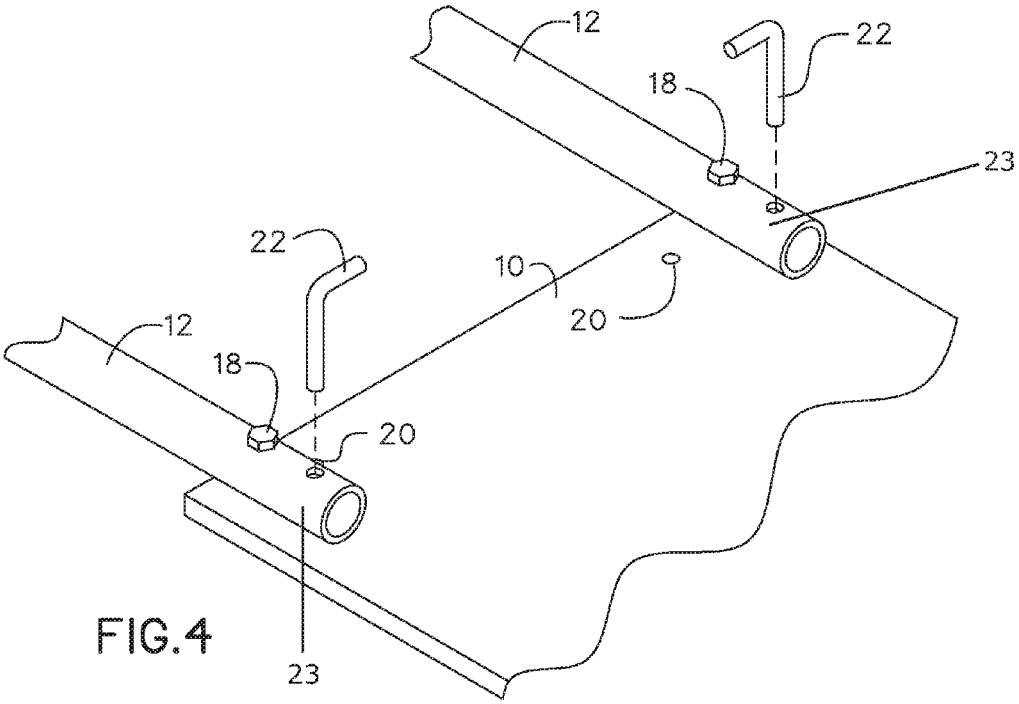
FIG. 4 is a detail exploded view of the present invention.
Figure 5:
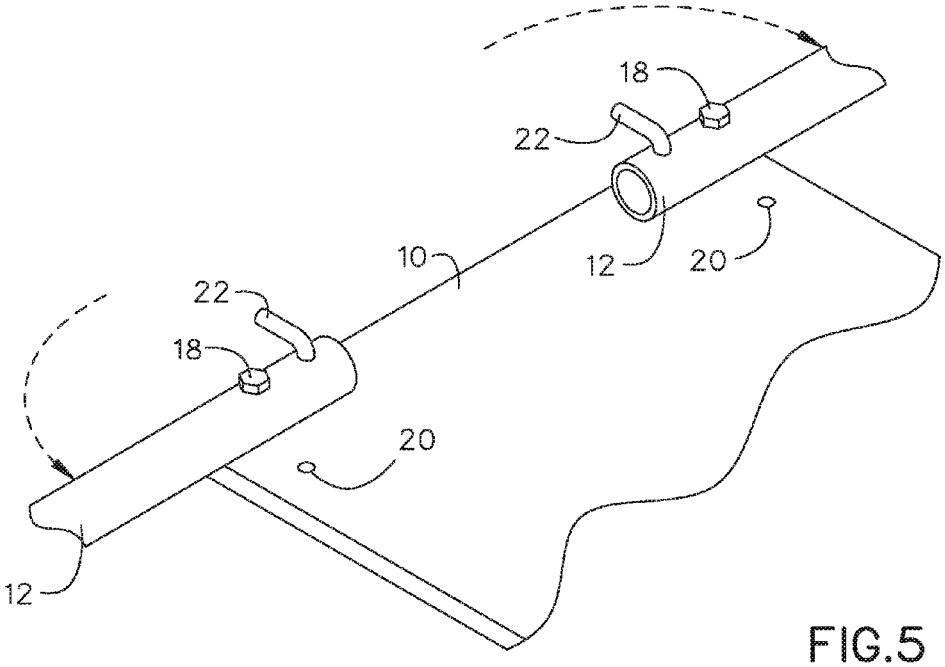
FIG. 5 is a detail perspective view of the present invention.
Figure 7:
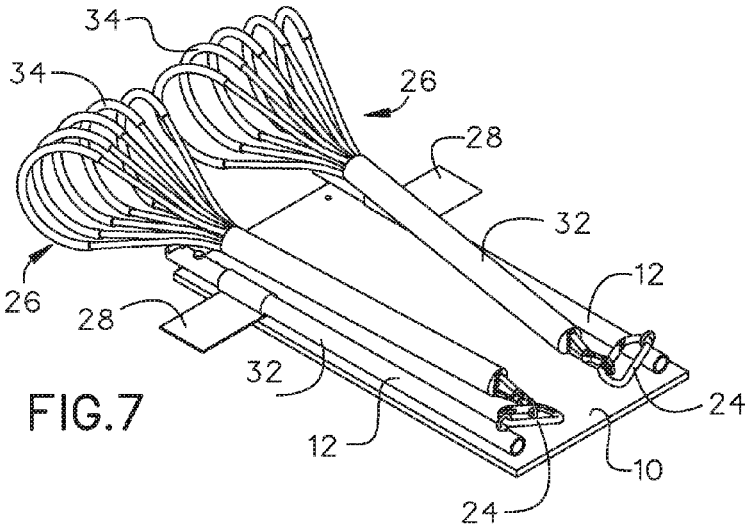
FIG. 7 is a perspective view of the present invention shown in a compressed form.
Figure 6:
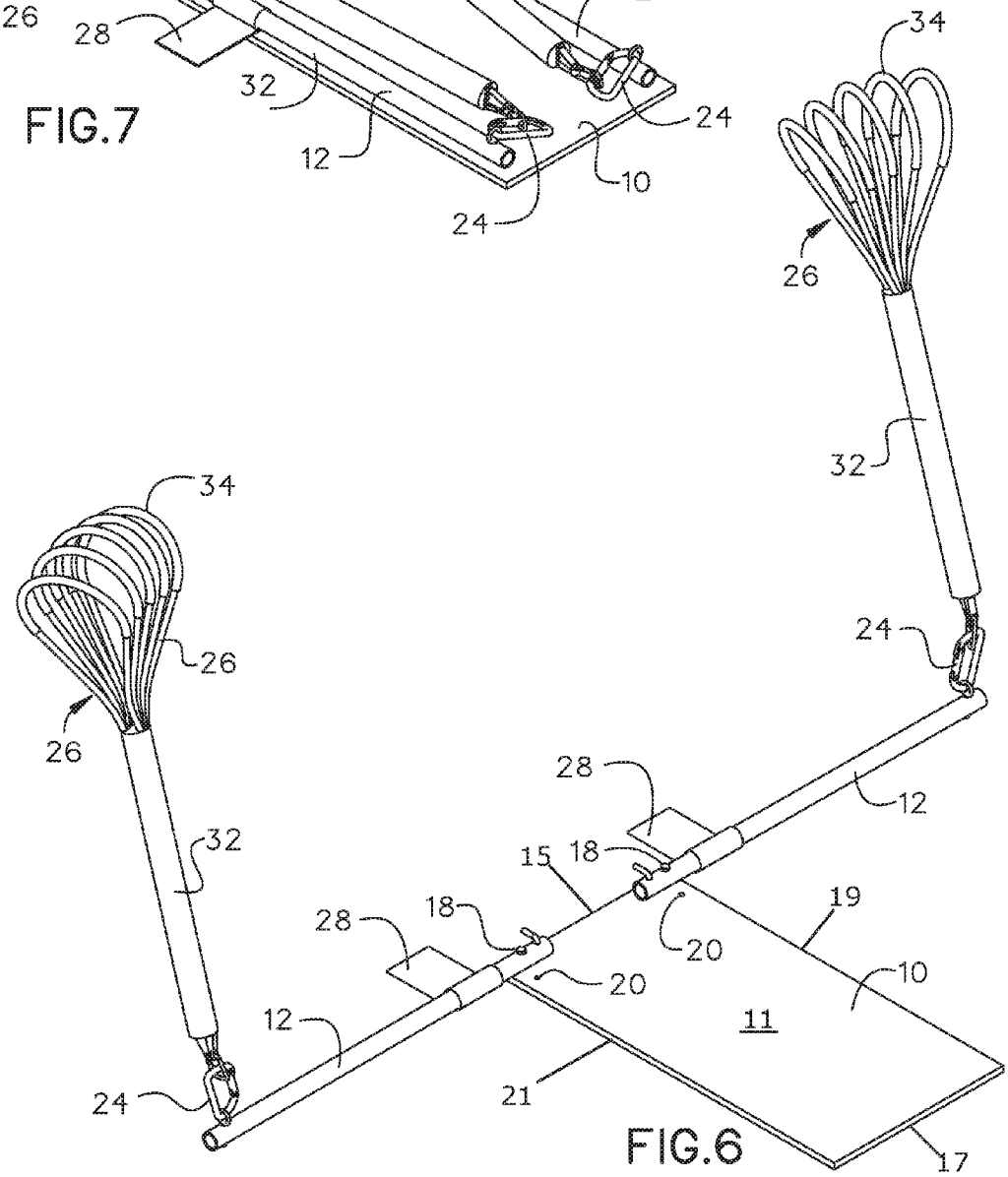
FIG. 6 is a perspective view of the present invention shown in an expanded form.

In certain embodiments, the plurality of arms 12 may include a first arm 12 and a second arm 12. The plurality of arms 12 may be pivotally attached to the platform by an arm pivot bolt 18 and a nut 16. The plurality of arms 12 may pivot along an axis substantially perpendicular to the top surface 11 of the platform 10. The first arm 12 may be attached to the top surface 11 of the platform 12 near the first end 15 and the first side 19, and the second arm 12 may be attached to the top surface 11 of the platform 12 near the first end 15 and the second side 21. The first arm 12 is capable of pivoting from a position including the first arm 12 extending laterally from the first side 19 to a position including extending laterally from the first end 15, as illustrated in FIGS. 4 and 5. The second arm 12 is capable of pivoting from a position including the second arm 12 extending laterally from the second side 21 to a position extending laterally from the first end 15, as illustrated in FIGS. 4 and 5.

In certain embodiments, the present invention may include a locking mechanism. The locking mechanism may include a locked position and an unlocked position. The locked position may include the first arm 12 and the second arm 12 being in a fixed position and the unlocked position may include the first arm 12 and the second arm 12 capable of pivoting. In certain embodiments, the locking mechanism may include openings 20 and a locking pin 22. A plurality of openings 20 may run through the top surface 11 of the platform 10. At least one opening 20 may run through the first arm 12 and the second arm 12. The plurality of openings 20 that run through the top surface 11 of the platform 12 are positioned to align with the at least one opening 20 running through the first arm 12 and the second arm 12 along the pivoting axis of the first arm 12 and the second arm 12. The locking pin 22 may be formed to fit through the at least one opening 20 through the first arm 12 and the second arm 12 and into the plurality of openings 20 through the top surface 11 of the platform 10, thereby locking the first arm 12 and the second arm 12 in place relative to the platform 10.

The present invention may include a plurality of resistance bands 26 extending from the second end 25 of the arms 12. The resistance bands 26 may include a first end and a second end. The second end may include handles 34 which may include handle covers that may be a flexible polymer cover, such as PVC tubing. The first end may be attached to the arms 12. In certain embodiments, the resistance bands 26 may be attached to the arms 12 by an eye bolt 14 mounted to the arms 12 attached to clips 24 that may be attached to the resistance bands 26. In certain embodiments, there may be a plurality of resistance bands 26 attached to the second end 25 of each arm 12, as illustrated in the Figures. A covering 32 may be around the plurality of the resistance bands 26 to contain the resistance bands 26 in an orderly fashion.

The present invention may in an expanded form for exercising and a compressed form for transportation. The expanded form may include the arms 12 extending laterally past the perimeter of the present invention. The arms 12 may pivot into the compressed form. The compressed form may include the first arm 12 and the second arm 12 pivoted towards the second end 17 of the platform 10. When the arms 12 are within the compressed form, the first arm 12 and the second arm 12 are substantially within the perimeter of the platform 10. Therefore, the present invention may be easier to transport.

The platform 10 of the present invention may be any desirable size so that a user may stand on the platform 10, and thereby grounding the device. The arms may 12 include tubing about 1 in. round. However, the arms 10 may be smaller or larger and made of square tubing. The resistance bands 26 may be different strengths. The straps 28 may be a piece of 3 in.×19 in. carpet wrapped around the arms 12 creating two straps 28 so they can slide up and down over arms 12. The straps 28 may be made of any appropriate material, such as, but not limited to, a polymer, such as plastic.

The arms 12 and bands 26 are attached to the platform 10 and folded on top. Pivoting the arms 12 out to the side and placing pull pins 22 in the opening 20 allows user to perform many different exercises with many different resistance by holding one or more bands. Then pulling the pins out, and pivoting the arms 10 to different positions enables a user 30 to perform many different types of exercises. When the workout is finished, the pins 20 may pulled out of the openings, the arms 12 may be pivoted and the bands 26 may be placed on top of the platform 10 to be neatly carried and stored. The straps 28 may be used to perform exercises by standing on the straps 28 while using the bands 26 to enable a user to be in different positions. Also the straps 28 may slide over the arms 12 down toward the platform 10 to be used with other exercises.

A method of using the present invention may include the following. Place the platform on a surface and pivot the arms to the side. Push the pins through the openings in the arms and the platform. Then grab the band or bands in each hand and stand on the platform to perform different exercises. Alternatively, a user may place a chair on the platform to perform different exercises. Also, the straps may slide towards the platform and chair legs may be placed on top of them to perform different exercises. The user may then pull the pins out, pivot the arms about 90 degrees so that the arms are protruding from the first end and place the pins in openings, locking the arms in place. The straps may slide toward the bands and the user may stand on them while grabbing the bands in each hand to perform different exercises. With these two different positions, the user may work out chest, shoulders, arms, leg and many others muscles. This machine may be used indoors or outdoors, in front of the television or in the office. The present invention may be used by men and women and users of all ages.

It should be understood, of course, that the foregoing relates to exemplary embodiments of the invention and that modifications may be made without departing from the spirit and scope of the invention as set forth in the following claims.

What is claimed is:

1. An exercise apparatus comprising:

a substantially flat platform comprising a top surface and an edge comprising a first end edge, a second end edge, a first side edge, and a second side edge, wherein the edge forms a perimeter of the platform;

a first arm comprising a first end opposite a second end, wherein the first end is pivotally attached to the top surface of the platform near the first end edge and the first side edge;

a second arm comprising a first end opposite a second end, wherein the first end is attached to the to surface of the platform near the first end edge and the second side edge, wherein each of the plurality of arms pivot along an axis substantially perpendicular to the to surface of the platform, wherein the first arm and the second arm comprise a first position comprising the first arm and the second arm substantially in between the edge, a second position comprising the first arm extending laterally beyond the first side edge and the second arm extending laterally beyond the second side edge, and a third position comprising the first arm and the second arm extending laterally beyond the first end edge;

and a plurality of resistance bands each comprising a first end opposite a second end, wherein the first end of at least one of the plurality of resistance bands is attached to the second end of each of the first arm and the second arm, and the second end of each of the plurality of resistance bands comprises a handle portion; and a locking mechanism comprising a locked position and an unlocked position, wherein the locked position comprises the first arm and the second arm being fixed relative to the platform in one of the second position and the third position, wherein the unlocked position comprises the first arm and the second arm being capable of pivoting between the first, second, and third positions.

2. The exercise apparatus of claim 1, wherein the locking mechanism comprises: a plurality of openings through the top surface of the platform; at least one opening through, each of the first arm and the second arm, wherein the plurality of openings through the top surface of the platform are respectively configured to align with the at least one opening through each of the first arm and the second arm along the respective pivoting axis of each of the first arm and the second arm; and at least one lock pin formed to fit through one of the at least one opening through each of the first arm and the second arm and into one of the plurality of openings through the top surface of the platform, such that the one of the plurality of openings through the top surface of the platform is positioned to align with the one of the at least one opening through each of the first arm and the second arm, thereby locking at least one of the first arm and the second arm in place relative to the platform.

3. The exercise apparatus of claim 1, wherein the plurality of resistance bands comprise a first set of a plurality of resistance bands attached to the second end of the first arm and a second set of a plurality of resistance bands attached to the second end of the second arm.

4. The exercise apparatus of claim 3, further comprising a covering around each of the first set and the second set of the plurality of resistance bands.

5. The exercise apparatus of claim 1, wherein the handle portion of each of the plurality of resistance straps comprises a handle comprising a polymer tubing.

6. The exercise apparatus of claim 1, wherein the first arm and the second arm are parallel relative to each other in the first position and the third position, and the first arm and the second arm are substantially co-linear in the second position.

* * * * *